US006598600B1

(12) United States Patent
Köllner

(10) Patent No.: US 6,598,600 B1
(45) Date of Patent: Jul. 29, 2003

(54) COOKING AREA COVER PANEL TO BE APPLIED SEPARATELY FOR A COOK-TOP WITH A SAFETY FILM

(75) Inventor: Hanns-Joachim Köllner, Düsseldorf (DE)

(73) Assignee: Wenko-Wenselaar GmbH & Co., KG, Hilden (DE)

( * ) Notice: Subject to any disclaimer, the term of this patent is extended or adjusted under 35 U.S.C. 154(b) by 0 days.

(21) Appl. No.: 09/664,081

(22) Filed: Sep. 18, 2000

(30) Foreign Application Priority Data

| | | |
|---|---|---|
| Dec. 20, 1999 | (DE) | 299 22 398 U |
| Feb. 10, 2000 | (DE) | 200 02 417 U |
| May 18, 2000 | (DE) | 200 08 855 U |

(51) Int. Cl.[7] ..... B32B 7/12

(52) U.S. Cl. ..... 126/211; 126/200; 428/49; 428/195; 428/437

(58) Field of Search ..... 126/211, 200; 428/195, 49, 437

(56) References Cited

U.S. PATENT DOCUMENTS

| | | | | |
|---|---|---|---|---|
| 3,974,316 A | * | 8/1976 | Jacquemin et al. | 428/437 |
| 4,704,418 A | * | 11/1987 | Gomez | 428/437 |
| 5,637,363 A | * | 6/1997 | Leray et al. | 428/437 |
| 6,257,228 B1 | * | 7/2001 | Braccini | 126/211 |

FOREIGN PATENT DOCUMENTS

| | | |
|---|---|---|
| DE | 2160992 | 6/1973 |
| DE | 2244595 | 7/1973 |
| DE | GM 7423838 U | 7/1974 |
| DE | 3716004 | 11/1988 |
| DE | 29913067 U | 2/2000 |
| GB | 1392560 | 4/1975 |

* cited by examiner

*Primary Examiner*—Henry Bennett
*Assistant Examiner*—James G. Barrow
(74) *Attorney, Agent, or Firm*—Crowell & Moring LLP

(57) ABSTRACT

A cooking area cover panel that is to be applied separately for a cooking area is produced of a substantially breaking-resistant material and has a safety film on at least one flat surface of the cooking area cover panel. The safety film is configured such that in the event of a fracture of the cooking area cover panel the safety film essentially holds the fragments together.

17 Claims, 2 Drawing Sheets

COOKING AREA COVER PANEL TO BE APPLIED SEPARATELY FOR A COOK-TOP WITH A SAFETY FILM

FIELD OF THE INVENTION

The present invention relates to a cooking area cover panel to be applied separately.

BACKGROUND OF THE INVENTION

Glass ceramic cooking areas are used very widely. They are relatively sensitive and require special care. To protect a glass ceramic cooking area when not in use, a cooking area cover panel such as that disclosed in German Utility Model 298 13 303 U1 may be used. Such a cover panel is made of a hard, scratch-resistant material, especially glass. Accordingly, the panel material is relatively brittle. Therefore, there is the risk that the cooking area cover panel when being used, for example, when placing a heavy object, such as a large cooking pot etc., carelessly on it, can shatter or at least break into individual pieces. The fragments can cause injuries, so there is a not insignificant risk of injury and accidents.

Cooking area cover panels are also known for other cooking areas, i.e., metal cooking areas with individually installed electric cooking plates, for example, or gas cooking areas with individually installed gas burners. The same considerations apply here as those discussed previously.

The problem on which the present invention is based is to provide a cooking area cover panel that will minimize the above-mentioned risks and hazards while permitting simple and reliable handling.

SUMMARY OF THE INVENTION

This object is achieved by a cooking area cover panel that is to be applied separately for a cooking area. The cooking area cover panel is produced of a substantially breaking-resistant material and has a safety film on at least one flat surface of the cooking area cover panel. The safety film is configured such that in the event of a fracture of the cooking area cover panel the safety film essentially holds the fragments together.

A basic idea of the present invention is to provide the cooking area cover panel with a safety film. In particular, the safety film is applied by gluing or is self-adhesive.

The safety film preferably consists of plastic. Such a safety film is available as an inexpensive material.

The safety film is preferably arranged on or applied to the underside of the cooking area cover panel, i.e., to the flat side of the cooking area cover panel facing the cooking area. This has the advantage that without requiring an extremely high thermal stability of the safety film, relatively hot objects such as cooking pots can be placed on the top side of the cooking area cover panel without causing any heating that would be critical for the safety film.

BRIEF DESCRIPTION OF THE DRAWINGS

Additional advantages, goals, properties and features of the present invention are derived from claims and from the drawings, which illustrate only embodiments, and from the discussion in this regard. The drawings show:

DETAILED DESCRIPTION OF THE INVENTION

Figure 1:
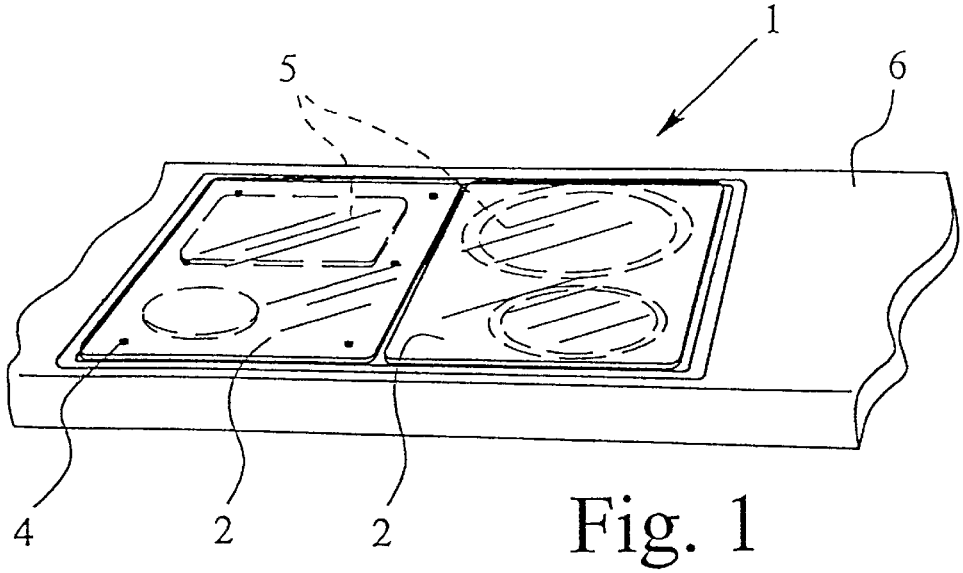
FIG. 1 a first embodiment with two cooking area cover panels of approximately the same size for a glass ceramic cooking area.

The embodiment illustrated in FIG. 1 shows a cooking area 1 made of glass ceramic here with two cooking area cover panels 2 to be applied separately. The cooking area 1 is installed in a kitchen working panel 6 in a known manner. Accordingly, the cooking area cover panels 2 provide an additional work surface when cooking area 1 is turned off, in addition to kitchen working panel 6. As explained above, the teaching according to the present invention applies to all types of cooking area cover panels 2, i.e., not just cooking area cover panels 2 for glass ceramic cooking areas.

In the first embodiment, two cooking area cover panels 2 are provided for one cooking area 1. As an alternative, however, it is also possible for just one cooking area panel 2 to be provided, in particular for one cooking area panel 2 that covers the entire cooking area 1 to be provided.

Figure 2:
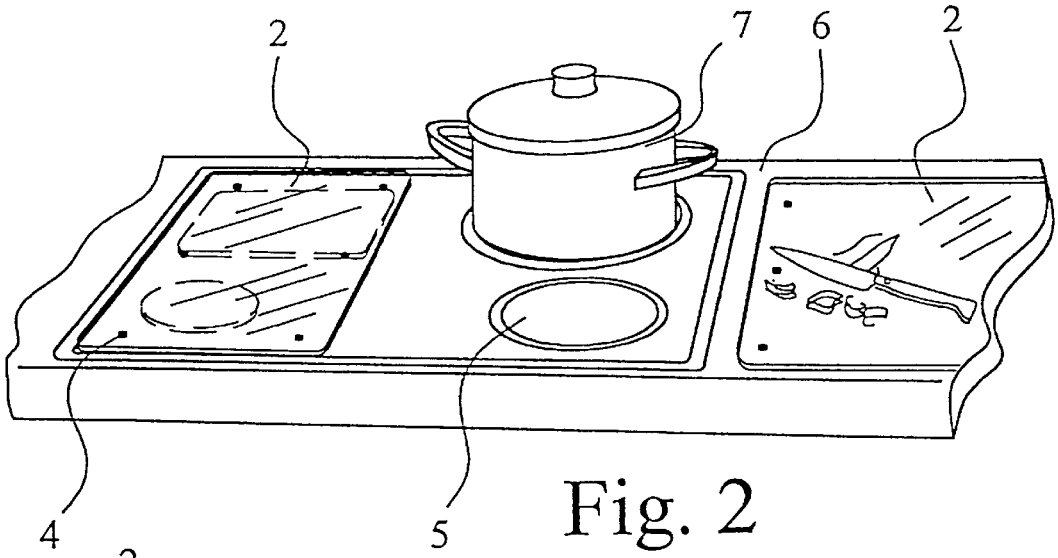
FIG. 2 another embodiment with cooking area cover panels of different sizes.

Instead of two cooking area cover panels 2 of the same size, cooking area cover panels 2 with different outside dimensions may also be used in combination. FIG. 2 illustrates such an embodiment.

Figure 4:
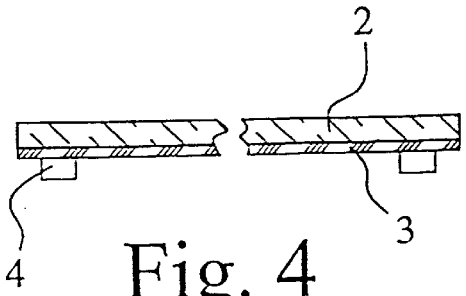
FIG. 4 a section through the cooking area over panel along line IV—IV from FIG. 3.

Each cooking area cover panel is produced of an at least substantially breaking-resistant, especially high-grade scratch-resistant and heat-resistant plate material, especially glass. Despite the high strength and load-bearing capacity of the panel material, the possibility of cooking area cover panel 2 becoming fractured, in particular when handled improperly, cannot be ruled out entirely. To hold the resulting fragments together, it is proposed according to the present invention that the cooking area cover panel 2 is to be covered with a safety film 3, as illustrated in the sectional view in FIG. 4.

The safety film 3 is arranged on a flat side of the cooking area cover panel 2, preferably on the underside facing the cooking area 1, in particular by gluing it there. In an alternative embodiment, the safety film 3 is self-adhesive.

The safety film 3 is preferably made of a plastic and has sufficient strength, permanent elasticity, adhesion and heat resistance to largely prevent individual fragments from coming loose when cooking area cover panel 2 is fractured. Furthermore, the safety film may be advantageously configured to resist brittling upon repeated heating. The cooking area cover panel with the safety film is configured to have sufficient thermal stability so that a hot cooking pot or another object with a temperature of at least 100° C. can be placed on the cooking area cover panel without damaging the cooking area cover panel or the safety film. The safety film is heat resistant to a temperature of at least 150° C., preferably to a temperature of about 180° C. Furthermore, the safety film has a thickness of about 0.05 mm to about 0.1 mm, for example, a thickness of about 0.075 mm. The cooking area cover panel is produced of a hard, scratch-resistant material which is preferably heat-resistant up to approximately 300° C.

Figure 3:
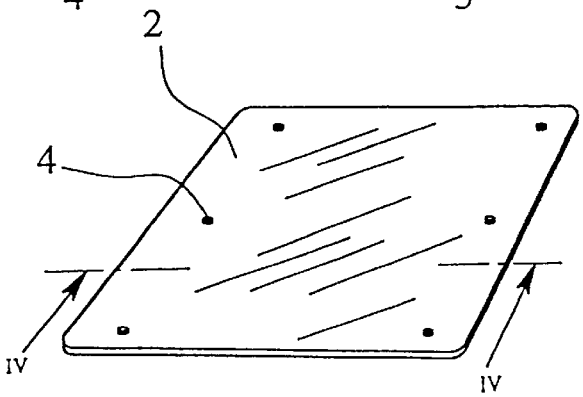
FIG. 3 an enlarged perspective view of a cooking area cover panel.

The perspective diagram according to FIG. 3 shows that the shape of the cooking area cover panel 2 is preferably at least essentially square or rectangular. However, this is not absolutely necessary; the cooking area cover panel 2 may also have other surface shapes.

The full coverage of a flat side by a safety film 3 results, in addition to a simple manufacture, in a high safety in the case of breakage of the cooking area cover panel 2.

In addition or as an alternative, safety film 3 may also be arranged on both flat surfaces of the cooking area cover panel 2, in particular by gluing it there.

Figure 5:
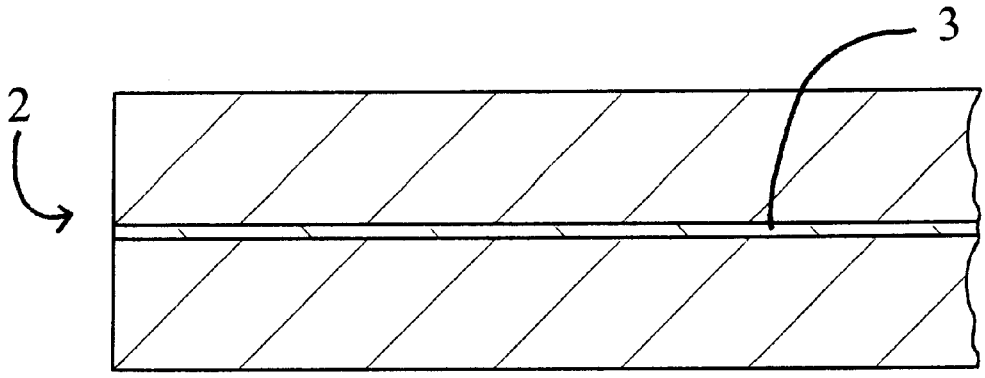
FIG. 5 a cross sectional view showing a safety film disposed between two glass plates.

As shown in FIG. 5, an alternative resides also in arranging the safety film 3 between two glass plates, i.e., realizing the principle of a composite glass cooking area cover panel 2.

Simple manufacturing is also achieved in particular with complete coverage of the entire under side of the cooking area cover panel 2 by the safety film 3 by the fact that the spacer feet 4 supporting the cooking area cover panel 2 are glued to the safety film 3. The spacer feet 4 should, of course, be comprised of a material that in any case withstands the temperatures of a switched-off and slowly cooling cooking area.

As an alternative, the feet may also be connected directly to the cooking area cover panel 2. In this case, the safety film 3 has corresponding recesses (not illustrated here) or openings that leave the cooking area cover panel 2 exposed.

The spacer feet 4 cause the cooking area cover panel 2 and the safety film 3 not to come to lie directly on the surface of the cooking area 1 or on hot plates or burners. This prevents or at least minimizes unwanted excessive heating of the safety film 3 by the cooking area 1—for example, due to residual heat after a cooking zone 5 or hot plate has been turned off or when cooking zone 5 has been unintentionally turned on (see FIG. 2). The spacer feet 4 are also expedient in order to be able to manipulate the cooking area cover panel 2 and to prevent sliding of the cooking area cover panel 2 when placing it and when performing manipulations on the cooking area cover panel 2.

FIG. 2 illustrates one practical application of the proposed cooking area cover panels 2 according to this invention. This shows two successive cooking zones 5 of cooking area 1 which are freely accessible, with a corresponding cooking pot 7 being indicated. The remaining area of the cooking area 1 is covered by a cooking area cover panel 2. The cooking area cover panel 2 also serves at the same time as an additional working surface, so to speak, close to the cooking pot 7 in addition to being a place of deposit next to the cooking pot 7 and the unused cooking zone 5. At the same time, the additional cooking area cover panel 2, which is shown at the right next to cooking area 1, may also serve as a place of deposit. Thus, especially with sensitive working panels 6, the working area at the side of the cooking area 1 can be protected especially well in this way.

Instead of high-quality fracture-resistant glass, another material, preferably in sheet form, may also be used to produce the cooking area cover panel 2. In particular, heat-resistant laminates, molded plastics or glass ceramic may be used here.

The safety film 3 is preferably designed so that no vapors, gases or other substances that are toxic or pathogenic for humans are formed even with excessive heating that would destroy safety film 3, and that it does not stick to other objects, in particular cooking area 1.

To provide an early indication of excessive heating, the safety film 3 may be designed so that strong smelling gases are released by the safety film 3 in the event of a certain heating, promptly signaling the unintentional or excess heating before the cooking area cover panel 2 is destroyed or there is some other risk.

The cooking area cover panel 2 and the safety film 3 are preferably designed to be transparent at least in some areas. Thus, the user may also see when a cooking zone 5 lights up, i.e., it is activated, even when cooking area 1 is covered. It is advantageous if the cooking area cover panel 2 is also provided with a decorative finish or the like to permit reliable awareness of cooking area cover panel 2 itself.

What is claimed is:

1. A cooking area cover panel for a cooking area, wherein the cooking area cover panel comprises a substantially break-resistant material, and a safety film on at least one flat surface of the break-resistant material, wherein the safety film is configured such that in the event of a fracture of the cooking area cover panel the safety film essentialy holds the fragments together, wherein the safety film is arranged on a flat surface of the break-resistant material that faces a cooking area.

2. The cooking area cover panel of claim 1, wherein the breaking-resistant material is glass.

3. The cooking area cover panel of claim 1, wherein the break-resistant material comprises two plates, and wherein the safety film is arranged between the two plates so that the cooking area cover panel is a three-layer composite plate.

4. The cooking area cover panel of claim 1, wherein the safety film is glued to the surface of the break-resistant material.

5. The cooking area cover panel of claim 1, wherein the safety film is configured to be self-adhesive.

6. The cooking area cover panel of claim 1, wherein the safety film is comprised of a substantially heat-resistant plastic material.

7. The cooking area cover panel of claim 1, wherein the safety film is configured to resist brittling.

8. The cooking area cover panel of claim 1, wherein the break-resistant material and the safety film are configured to have sufficient thermal stability so that a hot cooking pot or another object with a temperature of at least 100° C. can be placed on the cooking area cover panel without damaging the break-resistant material or the safety film.

9. The cooking area cover panel of claim 1, wherein the safety film is heat resistant.

10. The cooking area cover panel of claim 9, wherein the safety film is heat resistant to a temperature of at least 150° C.

11. The cooking area cover panel of claim 9, wherein the safety film is heat resistant to a temperature of about 180° C.

12. The cooking area cover panel of claim 1, wherein the safety film has a thickness of up to 0.1 mm.

13. The cooking area cover panel of claim 1, wherein the safety film has a thickness of about 0.05 mm to about 0.1 mm.

14. The cooking area cover panel of claim 1, wherein the safety film has a thickness of about 0.075 mm.

15. The cooking area cover panel of claim 1, wherein the break-resistant material and the safety film are configured to be transparent at least in some areas.

16. The cooking area cover panel of claim 1, wherein the break-resistant material is a hard, scratch-resistant material which is heat-resistant up to approximately 300° C.

17. The cooking area cover panel of claim 1, further comprising spacer feet glued to the break-resistant material or to the safety film.

* * * * *